US005775020A

United States Patent [19]

Baird

[11] Patent Number: 5,775,020

[45] Date of Patent: Jul. 7, 1998

[54] GUN BARREL CLEANER

[76] Inventor: Ian Franklin Baird, 4354 Highway 78, Santa Ysabel, Calif. 92070

[21] Appl. No.: 777,269

[22] Filed: Dec. 31, 1996

[51] Int. Cl.[6] ..... F41A 29/02

[52] U.S. Cl. ..... 42/95; 15/104.165; 15/88

[58] Field of Search ..... 42/90, 95, 96; 15/104.16, 104.165, 104.2, 88

[56] References Cited

U.S. PATENT DOCUMENTS

| | | | |
|---|---|---|---|
| 268,004 | 11/1882 | Davis | 15/104.16 |
| 464,843 | 12/1891 | Bagger | 42/95 |
| 1,133,571 | 3/1915 | Niedner | 42/95 |
| 1,552,994 | 9/1925 | Lindeman | 15/104.165 |
| 3,814,525 | 6/1974 | Spencer | 15/104.165 |
| 4,403,363 | 9/1983 | Hess | 15/88 |
| 4,858,360 | 8/1989 | Hardin | 42/95 |
| 5,075,998 | 12/1991 | Selleck | 15/104.16 |
| 5,245,777 | 9/1993 | Neuman et al. | 42/95 |

FOREIGN PATENT DOCUMENTS

| | | | |
|---|---|---|---|
| 704685 | 12/1979 | U.S.S.R. | 15/104.16 |
| 8459 | of 1910 | United Kingdom | 15/104.16 |

*Primary Examiner*—Stephen M. Johnson
*Attorney, Agent, or Firm*—Stephen Donovan

[57] ABSTRACT

A gun barrel bore cleaner having a hollow rod inserted a one end into a fluid receptacle and the other end of the hollow rod bearing an attached brush. Gun barrel cleaning fluid can travel from the fluid receptacle and through the hollow rod to exit from the hollow rod near the brush attachment.

6 Claims, 2 Drawing Sheets

GUN BARREL CLEANER

BACKGROUND

This invention relates generally to a gun barrel cleaner, and more particularly, is directed towards a gun barrel cleaner having a hollow tube attached to one end of a cleaning solvent receptacle.

A gun barrel is removed from the rails or support which hold it in contact with the grip or stock of the gun and cleaned periodically to remove the buildup of oxidation material, combustion residue and galling (metal to metal contact) by products. A gun barrel can be cleaned with considerable difficulty by stuffing and extracting a material such as a paper towel or a cloth into the bore of the barrel.

Known gun barrel cleaners are brushes, swaps or jags mounted on one end of a thin handle or tube holder. As used herein the word "brush" includes a brush as well as other devices for cleaning such as swabs, jag and pieces of cloth. The brush is dipped into a cleaning fluid, inserted into the bore of the barrel, rotated and then removed from the barrel, thereby removing or loosening the various grit and dirt items to be removed from the barrel. Applicant is not aware of any brush which incorporates a means for dispensing the barrel cleaning fluid so that there would be no need to dip the brush into the cleaning fluid. The current gun cleaning rods with an attached brush must be dipped into a separate container of cleaning solvent during the cleaning of the gun's bore. Continuous use of such current cleaning rods results in spillage and fouling the environment.

Thus there is a need for a self contained gun barrel cleaning rod plus cleaning fluid assembly. The needed device would be relatively inexpensive to manufacture, and also, would be easy to operate. The present invention fulfills these needs and provides further related advantages.

SUMMARY

The present invention is an improved gun cleaning rod for cleaning the bore of a gun barrel. The present device includes a hollow handle containing a solvent receptacle with a secured filter end cap. Opposite end of the filler end cap is an inserted hollow rod, manufactured of metal, carbon composite or like material. Once the receptacle handle is filled with cleaning solvent, it is transferred from the handle to the hollow rod through an access hole in the inserted end of the rod inside handle. The cleaning fluid travels through the center of the rod, exiting near the end of the rod, prior to the gun bore cleaning brush, swab or jag. Other feature and advantages of the present invention will become apparent from the following and more detailed description, taken in conjunction with the accompanying drawings, which illustrate, by way of example, the principles of the invention.

An embodiment of the invention is a gun barrel cleaner which comprises a fluid receptacle with a front portion and a rear portion and a removable cap over the rear portion of the fluid receptacle, the fluid receptacle having an internal cavity for containing a fluid for cleaning a bore of a gun barrel, a hollow rod with a first end and a second end, the first end of the hollow rod being inserted through the front portion of the fluid receptacle into the internal cavity of the fluid receptacle, and a brush, the brush being attached to the second end of the hollow rod. The a gun barrel cleaner fluid can be placed into the cavity in the fluid receptacle, the brush wetted by the fluid and the brush then used to clean the bore of a gun barrel by inserting the brush into a first end of a gun barrel, the gun barrel having a first end and a second end.

The gun barrel cleaner can further comprise a fluid collector placed over the second end of the gun barrel. The cap can have threads which mate with reciprocating threads on the rear portion of the fluid receptacle. The hollow rod can have a fluid exit port near the second end of the hollow rod.

The fluid collector can comprise an open first end and a second end with a removable cap, wherein the second end of the gun barrel in inserted into the open first end of the fluid collector.

A detailed embodiment of the present invention comprises a gun barrel cleaner having (a) a fluid receptacle with a front portion and a rear portion and a removable cap over the rear portion of the fluid receptacle, the fluid receptacle having an internal cavity for containing a fluid for cleaning a bore of a gun barrel, and wherein the removable cap has threads which mate with reciprocating threads on the rear portion of the fluid receptacle; (b) a hollow rod with a first end and a second end, the first end of the hollow rod being inserted through the front portion of the fluid receptacle into the internal cavity of the fluid receptacle, wherein the hollow rod further comprises a fluid exit port near the second end of the hollow rod; (c) a brush, the brush being attached to the second end of the hollow rod, wherein a gun barrel cleaner fluid can be placed into the cavity in the fluid receptacle, the brush wetted by the fluid and the brush then used to clean the bore of a gun barrel by inserting the brush into a first end of a gun barrel, the gun barrel having a first end and a second end, and; (d) a fluid collector placed over the second end of the gun barrel, wherein the fluid collector comprises an open first end and a second end with a removable cap, wherein the second end of the gun barrel in inserted into the open first end of the fluid collector.

DRAWINGS

DESCRIPTION

Figure 1:
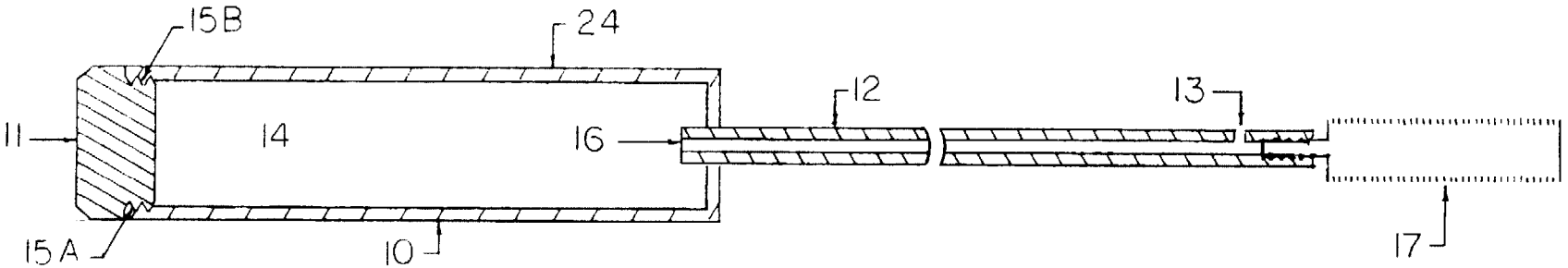
FIG. 1 is longitudinal cross sectional view of an embodiment of the present gun cleaner invention.

FIG. 1 shows a gun cleaner 10 with a hollow solvent dispenser rod 12. The rod 12 is inserted into the front end of a fluid receptacle 24 of the gun cleaner 10, and into the cavity 14. 11 is the removable cap which allows access of cleaning solvent into the cavity 14. After the cavity 14 is filled with a cleaning fluid (not shown), the leak proof removable cap 11 is secured to the fluid receptacle 24 by means of mating threads 15A and 15B on respectively, an inner surface of the fluid receptacle 24 and an outer surface of the cap 11. The cleaning fluid can enter the hollow rod 12 through its first end 16. The fluid then travels through the hollow rod 12 to exit at the port 13, thereby wetting a brush or swab area 17.

Figure 2:
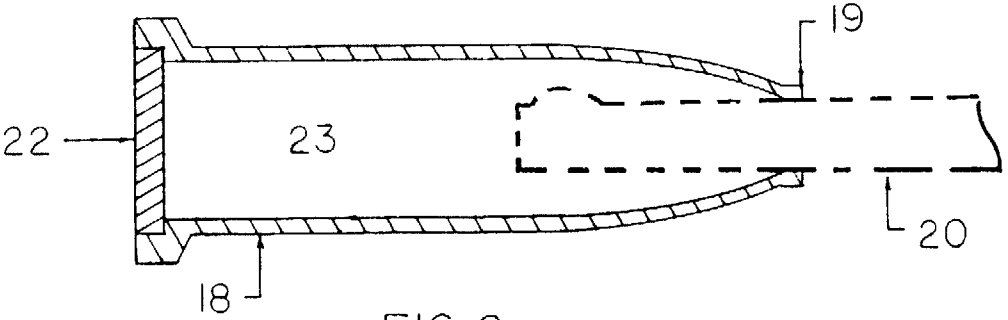
FIG. 2 is a longitudinal cross sectional view of a fluid receptacle which can be used in conjunction with the gun cleaner invention of FIG. 1.

FIG. 2 shows a gun barrel 20 (not part of the invention) with a cleaning solvent or fluid collector 18 held securely on a gun barrel by placing an open end 19 of the fluid collector 18 over the gun barrel 20. When solvent exits port 13 on FIG 1, the fluid can passes down through the gun barrel 20 to be collected in the fluid collector 18 and thereby captured for recycling the solvent. An end cap 22 on one end of the fluid collector 18 permits access to the cavity 23.

I claim:

1. A gun barrel cleaner, comprising:

(a) a fluid receptacle with a front portion and a rear portion and a removable cap over the rear portion of the fluid receptacle, the fluid receptacle having an internal cavity for containing a fluid for cleaning a bore of a gun barrel;

(b) a hollow rod with a first end and a second end, the first end of the hollow rod being inserted through the front portion of the fluid receptacle into the internal cavity of the fluid receptacle, and (c) a brush, the brush being attached to the second end of the hollow rod, (d) a fluid collector placed over the second end of the gun barrel, wherein the fluid collector comprises an open first end and a second end with a removable cap, wherein the second end of the gun barrel is inserted into the open first end of the fluid collector, wherein the gun barrel cleaner fluid can be placed into the cavity in the fluid receptacle, the brush wetted by the fluid and the brush then used to clean the bore of the gun barrel by inserting the brush into a first end of the gun barrel, the gun barrel having the first end and a second end.

2. The gun barrel cleaner of claim 1 wherein the removable cap over the rear portion of the fluid receptacle has threads which mate with reciprocating threads on the rear portion of the fluid receptacle.

3. The gun barrel cleaner of claim 2, wherein:

(a) the removable cap over the rear portion of the fluid receptacle is a leak proof cap;

(b) the threads of the removable cap over the rear portion of the fluid receptacle are on an outer surface of the removable cap, and;

(c) the reciprocating threads on the rear portion of the fluid receptacle are on an inner surface of the fluid receptacle.

4. The gun barrel cleaner of claim 1, wherein the hollow rod further comprises a fluid exit port near the second end of the hollow rod.

5. A gun barrel cleaner, comprising:

(a) a fluid receptacle with a front portion and a rear portion and a removable cap over the rear portion of the fluid receptacle, the fluid receptacle having an internal cavity for containing a fluid for cleaning a bore of a gun barrel, and wherein the removable cap has threads which mate with reciprocating threads on the rear portion of the fluid receptacle;

(b) a hollow rod with a first end and a second end, the first end of the hollow rod being inserted through the front portion of the fluid receptacle into the internal cavity of the fluid receptacle, wherein the hollow rod further comprises a fluid exit port near the second end of the hollow rod;

(c) a brush, the brush being attached to the second end of the hollow rod, wherein the gun barrel cleaner fluid can be placed into the cavity in the fluid receptacle, the brush wetted by the fluid and the brush then used to clean the bore of the gun barrel by inserting the brush into a first end of the gun barrel, the gun barrel having the first end and a second end, and;

(d) a fluid collector placed over the second end of the gun barrel, wherein the fluid collector comprises an open first end and a second end with a removable cap, wherein the second end of the gun barrel in inserted into the open first end of the fluid collector.

6. The gun barrel cleaner of claim 5, wherein:

(a) the removable cap over the rear portion of the fluid receptacle is a leak proof cap;

(b) the threads of the removable cap over the rear portion of the fluid receptacle are on an outer surface of the removable cap, and;

(c) the reciprocating threads on the rear portion of the fluid receptacle are on an inner surface of the fluid receptacle.

* * * * *